US011359900B2

(12) United States Patent
Kim et al.

(10) Patent No.: US 11,359,900 B2
(45) Date of Patent: Jun. 14, 2022

(54) DETONATOR, METHOD OF OPERATING SAME, AND COMMUNICATION SYSTEM FOR SAME

(71) Applicant: HANWHA CORPORATION, Seoul (KR)

(72) Inventors: Se Ho Kim, Boeun-gun (KR); Jeong Ho Choi, Boeun-gun (KR)

(73) Assignee: HANWHA CORPORATION, Seoul (KR)

( * ) Notice: Subject to any disclaimer, the term of this patent is extended or adjusted under 35 U.S.C. 154(b) by 285 days.

(21) Appl. No.: 16/627,431

(22) PCT Filed: Dec. 16, 2019

(86) PCT No.: PCT/KR2019/017764
§ 371 (c)(1),
(2) Date: Dec. 30, 2019

(87) PCT Pub. No.: WO2020/138797
PCT Pub. Date: Jul. 2, 2020

(65) Prior Publication Data

US 2022/0034640 A1 Feb. 3, 2022

(30) Foreign Application Priority Data

Dec. 28, 2018 (KR) ..... 10-2018-0172461

(51) Int. Cl.
*F42D 1/055* (2006.01)
*F42D 3/04* (2006.01)

(52) U.S. Cl.
CPC ..... *F42D 1/055* (2013.01); *F42D 3/04* (2013.01)

(58) Field of Classification Search
CPC ... F42D 1/05; F42D 1/055; F42D 3/00; F42D 3/02; F42D 3/04; F42D 3/06
See application file for complete search history.

(56) References Cited

U.S. PATENT DOCUMENTS 4,674,047 A * 6/1987 Tyler ..... F42D 1/055 102/200
4,825,765 A * 5/1989 Ochi ..... F42D 1/055 102/206
6,789,483 B1 9/2004 Jennings, III et al.
2005/0034623 A1 2/2005 Jennings
2021/0333076 A1* 10/2021 Kim ..... F42C 19/12

FOREIGN PATENT DOCUMENTS

GB 1578658 A * 11/1980 ..... F42D 1/05
KR 10-1293801 B1 8/2013
KR 20130010655 * 8/2013
KR 10-2013-0129724 A 11/2013
KR 20130129724 A * 11/2013

* cited by examiner

*Primary Examiner* — Bret Hayes
(74) *Attorney, Agent, or Firm* — WHDA, LLP

(57) ABSTRACT

A detonator includes a control circuit and a charging circuit. The control circuit receives a first signal transmitted using a voltage applied to a cable by a blasting device and transmits a second signal to the blasting device using a current flowing to the cable. The charging circuit performs a charging operation by receiving the voltage through the cable. The charging circuit stops the charging operation while the control circuit transmits the second signal to the blasting device.

11 Claims, 8 Drawing Sheets

DETONATOR, METHOD OF OPERATING SAME, AND COMMUNICATION SYSTEM FOR SAME

TECHNICAL FIELD

Embodiments of the present invention relate to a detonator, a method of operating the same, and a communication system for the same and, more particularly, to a detonator, a method of operating the same, and a communication system for the same, in which an operation of charging the detonator can be stopped while the detonator transmits a signal to a blasting device, thereby reducing an amount of charge current and improving a signal-to-noise ratio (SNR).

BACKGROUND ART

In general, explosives are used in engineering work, such as rock blasting for tunnel construction and the demolition of buildings. That is, a plurality of holes, into which explosives are to be inserted, is drilled corresponding to the sections of a blasting target, i.e. the object to be blasted. After an explosive is inserted into each of the drilled holes, the explosives are connected to a blasting system. The explosives are exploded by operating the blasting system, thereby blasting the blasting target.

Such a blasting system includes a detonator serving as an igniter to ignite an explosive and a blasting device providing power necessary for the actuation of the detonator and a command signal to the detonator. Here, the detonator of the blasting system is generally implemented as an electric detonator. The electric detonator is disposed on an explosive side, and a plurality of electric detonators is connected to a single blasting device.

Such electric detonators may have a structure in which a plurality of detonators connected to a blasting device is simultaneously activated to simultaneously detonate explosives, or a structure in which a plurality of detonators connected to a blasting device is set at different delay times to be sequentially activated to thus sequentially detonate explosives.

Although electric detonators simultaneously detonating a plurality of explosives have been used to date, electric detonators sequentially detonating a plurality of explosives are more commonly used at present. For example, blasting systems using such an electric detonator are disclosed in a plurality of documents, such as Korean Patent No. 10-1016538, Korean Patent No. 10-0665878, Korean Patent No. 10-0665880, Korean Patent No. 10-0733346, and Japanese Patent Application Publication No. 2005-520115.

DISCLOSURE

Technical Problem

Accordingly, the present invention has been made keeping in mind the above problems occurring in the prior art, and an objective of the present invention is to provide a detonator, a method of operating the same, and a communication system for the same, in which an operation of charging the detonator can be stopped while the detonator transmits a signal to a blasting device, thereby reducing a charge current and improving a signal-to-noise ratio.

Another objective of the present invention is to provide a detonator, a method of operating the same, and a communication system for the same, in which a variation in a reference current depending on changes in the number of detonators can be reduced, thereby increasing the maximum number of detonators with which communication is possible.

Technical Solution

In order to accomplish at least one of the above objectives, a detonator according to embodiments of the present invention may include: a control circuit receiving a first signal transmitted using a voltage applied to a cable by a blasting device and transmitting a second signal to the blasting device using a current flowing to the cable; and a charging circuit performing a charging operation by receiving the voltage through the cable, wherein the charging circuit stops the charging operation while the control circuit transmits the second signal to the blasting device.

The charging circuit may include: a charger performing the charging operation by receiving a voltage supplied thereto; and a charging switch disposed between the charger and the cable to control a supply of the voltage to the charger in response to a charge signal. The control circuit may transmit the charge signal to the charging switch while the control circuit transmits the second signal to the blasting device.

The charging switch may include a switch that is turned off while the charge signal is provided.

The control circuit may include: a voltage meter extracting the first signal by measuring the voltage; a controller receiving the first signal and generating a toggle signal; and a control switch disposed on the cable to control the current flowing to the cable in response to the toggle signal.

The control switch may include a switch that is turned off while the toggle signal is provided.

The control circuit may count a delay time included in the first signal and generates a blasting signal and a blasting voltage.

The detonator may further include an ignition circuit to supply the blasting voltage to a fuse head in response to the blasting signal.

According to embodiments of the present invention, provided is a method of operating a detonator, in which the detonator includes a control circuit counting a delay time included in a first signal and generating a blasting signal and a blasting voltage and a charging circuit providing a driving voltage to the control circuit. The method may include: performing, by the charging circuit, a charging operation by receiving a voltage from a blasting device through a cable during a first period; receiving, by the control circuit, a first signal transmitted using a voltage applied to the cable by the blasting device during a second period; and transmitting, by the control circuit, a second signal to the blasting device using a current flowing to the cable and stopping, by the charging circuit, the charging operation during a third period.

At least a portion of the first period may overlap the second period.

The second period and the third period may be continuous with each other.

According to embodiments of the present invention, provided is a communication system including a transmitter and a receiver connected through a cable. The transmitter may transmit a first signal to the receiver using a voltage applied to the cable. The receiver may include: a control circuit receiving the first signal and transmitting a second signal to the transmitter using a current flowing to the cable; and a charging circuit performing a charging operation by receiving the voltage through the cable. The charging circuit may stop the charging operation while the control circuit transmits the second signal to the blasting device.

The charging circuit may include: a charger performing the charging operation by receiving the voltage supplied thereto; and a charging switch disposed between the charger and the cable to control a supply of the voltage to the charger, in response to a charge signal. The control circuit may transmit the charge signal to the charging switch while the control circuit transmits the second signal to the transmitter.

The charging switch may include a switch that is turned off while the charge signal is provided.

The control circuit may include: a voltage meter extracting the first signal by measuring the voltage; a controller receiving the first signal and generating a toggle signal; and a control switch disposed on the cable to control the current flowing to the cable in response to the toggle signal.

The control switch may include a switch that is turned off while the toggle signal is provided.

Advantageous Effects

The detonator, the method operating the same, and the communication system for the same according to embodiments of the present invention can stop charging the detonator with a voltage while the detonator transmits a signal to a blasting device, thereby reducing an amount of charging current and improving a signal-to-noise ratio (SNR).

In addition, the detonator, the method operating the same, and the communication system for the same according to embodiments of the present invention can reduce a variation in a reference current depending on changes in the number of detonators, thereby increasing the maximum number of detonators with which communication is possible.

The advantages obtainable from the present invention are not limited to the aforementioned advantages and other advantages not explicitly disclosed herein will be clearly understood by those skilled in the art to which the present invention pertains from the description provided hereinafter.

Figure 1A:
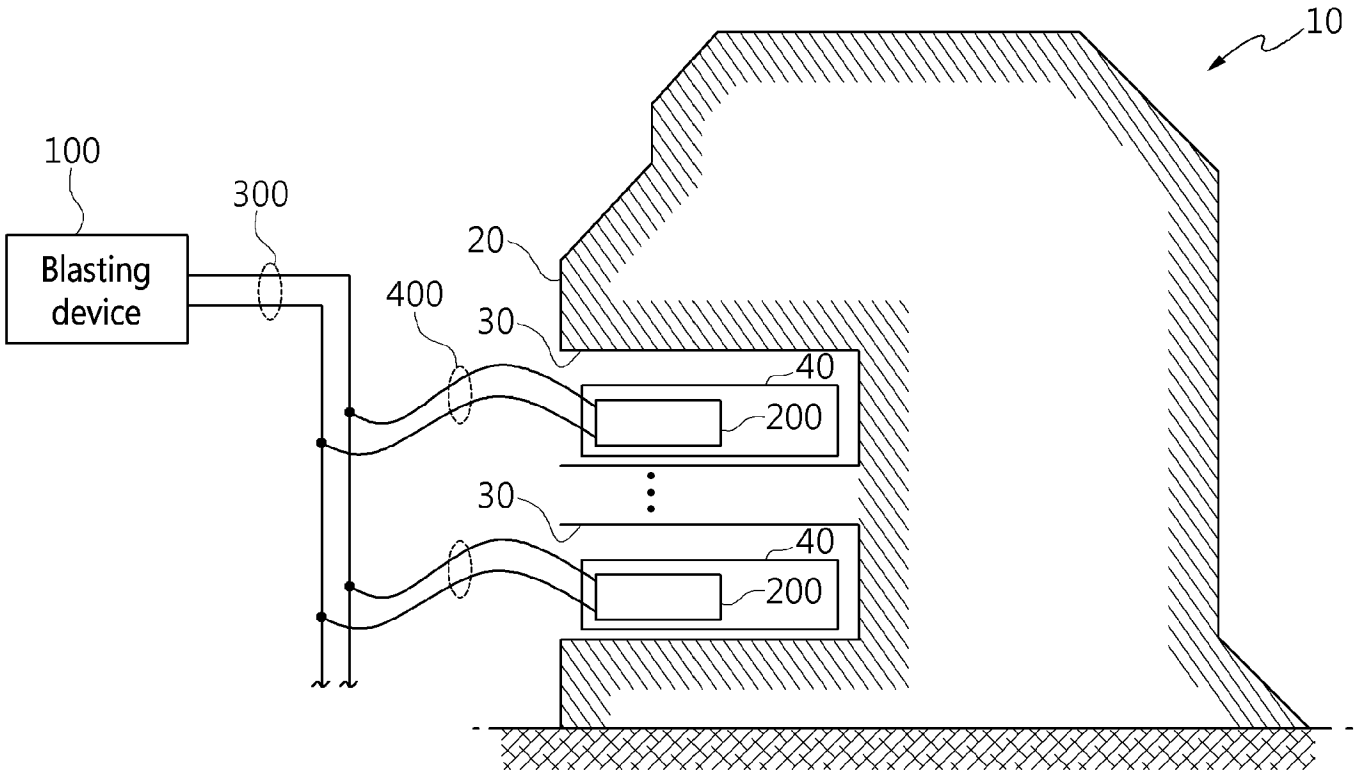
FIG. 1*a* is a conceptual view illustrating a blasting system according to embodiments of the present invention.

| [Description of the Reference Numerals in the Drawings] | |
|---|---|
| 10: blasting system | 20: blasting target |

-continued

| [Description of the Reference Numerals in the Drawings] | |
|---|---|
| 30: blasting hole | 40: explosive |
| 100: blasting device | 110: blasting controller |
| 120: voltage supply | 130: current meter |
| 200: detonator | 210: charging circuit |
| 220: control circuit | 230: ignition circuit |
| 240: fuse head | |

BEST MODE

Hereinafter, embodiments of the present invention and matters necessary for those skilled in the art to readily understand the features of the present invention will be described in detail with reference to the accompanying drawings. These embodiments are provided only for illustrative purposes, since the present invention may be implemented in a variety of different forms without departing from the scope of the present invention defined by the claims.

In the drawings, the same components will be designated by the same reference numerals. In addition, the thicknesses, ratios, and sizes of the components may be exaggerated for effective descriptions of technical features. The expression "and/or" includes any one or any combination of the mentioned items.

Terms, such as "first" and "second", may be used herein to describe a variety of components, and the components should not be limited by the terms. The terms are only used to distinguish one component from other components. Thus, a first component may be referred to as a second component, and similarly, a second component may be referred to as a first component. Singular forms used herein are intended to mean "one or more" unless the context clearly indicates otherwise.

Terms, such as "below", "beneath", "under", "lower", "above", and "upper", may be used herein for ease of description of the relationship of a component to other components as illustrated in the drawings. Such terms should be construed as describing relative relationships, and are used with respect to the orientations depicted in the drawings.

It will be further understood that the terms "comprise", "include", "have", etc. when used in this specification specify the presence of stated features, integers, steps, operations, components, parts, and/or combinations thereof, but do not preclude the presence or addition of one or more other features, integers, steps, operations, components, parts, and/or combinations thereof.

That is, the present disclosure is not limited to the embodiments disclosed below, and may be realized in various other forms. It will be understood that when an element is referred to as being "connected" to another element, not only can it be directly connected to the other element, but it can also be electrically connected to the other element via an intervening element. In designating elements of the drawings by reference numerals, the same elements will be designated by the same reference numerals even when they are shown in different drawings.

FIG. 1*a* is a conceptual view illustrating a blasting system 10 according to embodiments of the present invention.

Referring to FIG. 1*a*, the blasting system 10 may include a blasting device 100, detonators 200, and cables 300 and 400.

Blasting operators may form blasting holes 30 by perforating a blasting target 20 in order to explode the blasting target 20. Blasting operators may insert explosives 40 into the blasting holes 30, with the explosives 40 having the detonators 200 attached thereto, respectively.

The blasting device 100 and the detonators 200 may be connected through a wired communication means including the cables 300 and 400. The cables 300 and 400 may include main cables 300 and sub-cables 400. The main cables 300 may be electric wires directly connected to the blasting device 100, while the sub-cables 400 may be electric wires directly connected to the detonators 200. As a result, the main cables 300 and the sub-cables 400 may be connected, so that the blasting device 100 and the detonators 200 may be electrically connected for communications. In some embodiments, the cables 300 and 400 may be implemented as a two-line wired communication system.

A blasting operator may scan the detonators 200 using the operator's terminal device (e.g. a smartphone and/or a scanner). For example, the blasting operator may scan the detonators 200 by capturing images of image codes (e.g. quick response (QR) codes or bar codes) attached to the detonators 200 or personally logging the image codes. The operator's terminal device may transmit detonator information and initialization information regarding each of the scanned detonators 200 to the blasting device 100.

The blasting device 100 may store the detonator information and the initialization information regarding each of the detonators 200 received from the operator's terminal device. When the scanning of the detonators 200 is completed, the blasting device 100 may be connected to the detonators 200 through the cables 300 and 400.

The operator may generate a first signal (e.g. a general signal or a blasting command) by operating the blasting device 100 in order to start blasting. In addition, the blasting device 100 may receive the first signal through the cables 300 and 400 on the basis of the above-described connection relationship. Details with regard thereto will be described later with reference to FIG. 7.

In some embodiments, the first signal may be a blasting command including delay times corresponding to respective detonators 200. However, the present invention is not limited thereto. The detonators 200 may start counting ignition start times included in the first signal. When the counting of the delay time is completed, the detonators 200 may detonate the explosives 40 connected thereto. Accordingly, the blasting device 100 may explode the blasting target by detonating the plurality of explosives 40.

Figure 1B:
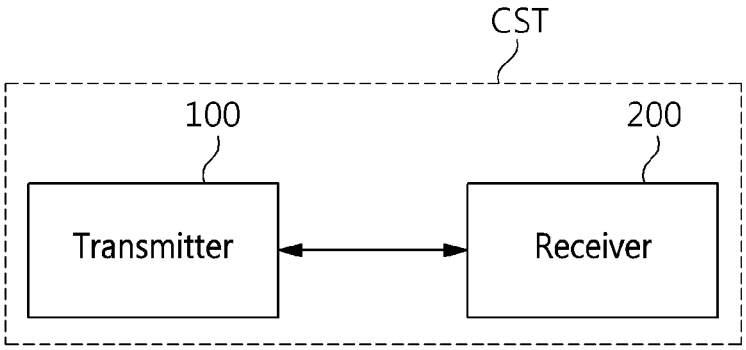
FIG. 1*b* is a block diagram illustrating a communication system according to embodiments of the present invention.

FIG. 1*b* is a block diagram illustrating a communication system according to embodiments of the present invention. Referring to FIG. 1*b*, a communication system CST may include a transmitter 100 and a receiver 200.

In some embodiments, the communication system CST may be used in a blasting system, a fire alarm system, or the like. The communication system CST used in a blasting system will be representatively described in the specification. However, the present invention is not limited thereto, and the communication system CST used in the blasting system may be applied to different embodiments (e.g. a fire alarm system) while being easily modifiable by those skilled in the art.

For example, in the blasting system 10 illustrated in FIG. 1*a*, the communication system CST may be a communication system between the blasting device 100 and the detonators 200. The transmitter 100 is a component corresponding to the blasting device 100 illustrated in FIG. 1*a*. Herein, the transmitter 100 may be the blasting device 100. The receiver 200 is a component corresponding to each of the detonators 200 illustrated in FIG. 1*a*. Herein, the receiver 200 may be the detonator 200.

The transmitter 100 may transmit a signal to the receiver 200 using a voltage, and the receiver 200 may transmit a signal to the transmitter 100 using a current. For example, the transmitter 100 and the receiver 200 may be connected to each other through the cables 300 and 400 (see FIG. 1*a*). Here, the transmitter 100 may transmit a signal to the receiver 200 using the voltage of the cables 300 and 400 (i.e. reference voltage). The receiver 200 may receive the signal, transmitted by the transmitter 100, by measuring the voltages of the cables 300 and 400.

The receiver 200 may transmit a signal to the transmitter 100 in response to the signal received from the transmitter 100. Here, the receiver 200 may transmit the signal using the current flowing through the cables 300 and 400 (i.e. reference current). The transmitter 100 may receive the signal, transmitted by the receiver 200, by measuring the current flowing through the cables 300 and 400.

According to the above description, the communication system CST may carry out wired communications.

Figure 2:
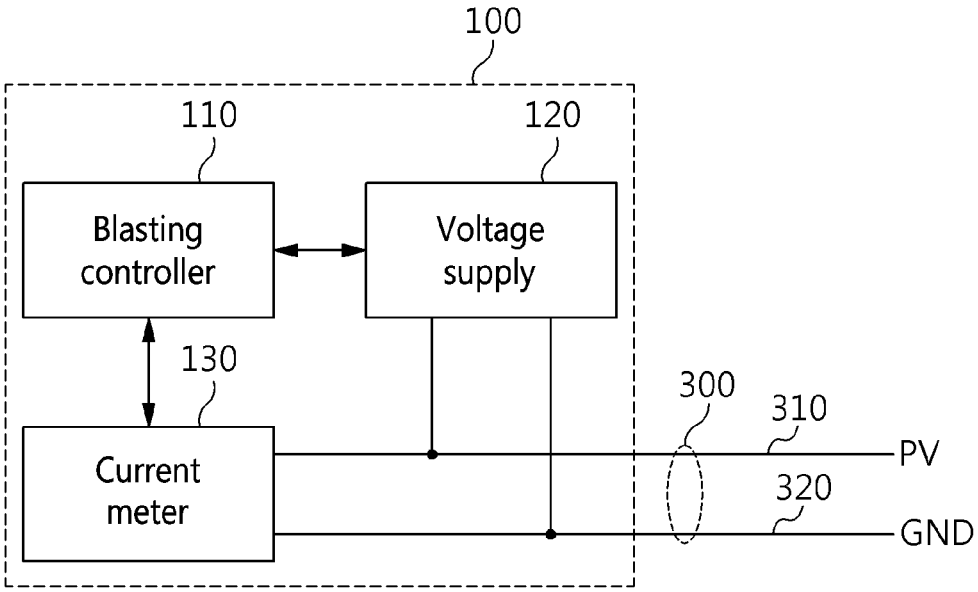
FIG. 2 is a diagram illustrating a blasting device according to embodiments of the present invention.

FIG. 2 is a diagram illustrating the blasting device 100 according to embodiments of the present invention.

Referring to FIG. 2, the blasting device 100 may include a blasting controller 110, a voltage supply 120, and a current meter 130. As illustrated in FIG. 2, the main cables 300 connected to the blasting device 100 may include a first main cable 310 and a second main cable 320.

The blasting controller 110 may control the overall operation of the blasting device 100. In some embodiments, the blasting controller 110 may be implemented as a central processing unit (CPU), a microprocessor unit (MPU), a graphics processing unit (GPU), a micro controller unit (MCU), or the like.

The voltage supply 120 may operate under the control of the blasting controller 110.

The voltage supply 120 may supply voltages to the main cables 300. For example, the voltage supply 120 may supply a reference voltage PV to the first main cable 310 and a ground voltage GND to the second main cable 320. In some embodiments, the reference voltage PV may range from 0V to 100V, while the ground voltage GND may be 0V. However, the present invention is not limited thereto, and the reference voltage PV and the ground voltage GND may have a variety of values, as long as the objective of the present invention is realized.

The voltage supply 120 may not only supply power, but may also transmit a signal, data, and the like to the detonator 200 (see FIG. 1*a*) using the reference voltage PV and the ground voltage GND. For example, the voltage supply 120 may provide a pulse signal to the main cables 300 using the reference voltage PV, and the detonator 200 may detect the pulse signal provided through the sub-cables 400 (see FIG. 1*a*) connected to the main cables 300. In this manner, the voltage supply 120 may transmit a signal, data, and the like to the detonator 200. Details with regard thereto will be described later with reference to FIG. 7.

The current meter 130 may operate under the control of the blasting controller 110. Specifically, the current meter 130 may measure the current flowing through the first main cable 310 and the second main cable 320, among the main cables 300. The current meter 130 may receive a signal, data, and the like from the detonator 200 by measuring the current flowing through the main cables 300. For example, the detonator 200 may control the flow of the reference current supplied to the cables 300 and 400, and the current meter 130 may measure the reference current flowing through the cables 300 and 400.

Although the blasting controller 110, the voltage supply 120, and the current meter 130 are illustrated as being separate components in FIG. 2, the present invention is not limited thereto. In some embodiments, at least some of the blasting controller 110, the voltage supply 120, and the current meter 130 may be integrated.

Figure 3:
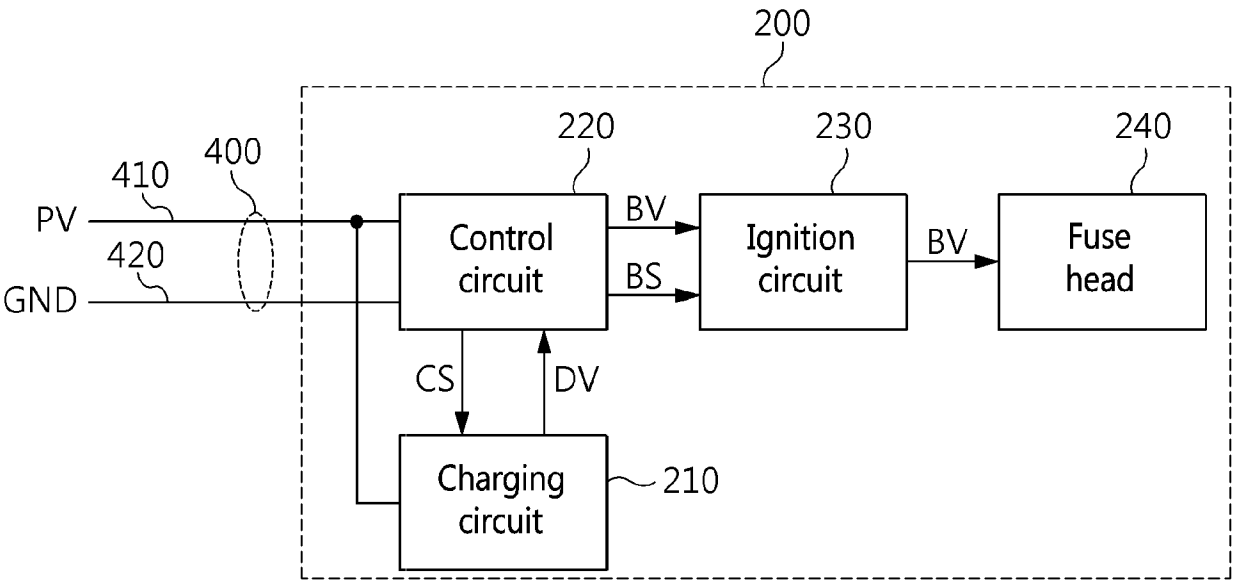
FIG. 3 is a diagram illustrating a detonator according to embodiments of the present invention.

FIG. 3 is a diagram illustrating the detonator 200 according to embodiments of the present invention.

Referring to FIG. 3, the detonator 200 may include a charging circuit 210, a control circuit 220, an ignition circuit 230, and a fuse head 240. As illustrated in FIG. 3, the sub-cables 400 connected to the detonator 200 may include a first sub-cable 410 and a second sub-cable 420.

The charging circuit 210 may receive the reference voltage PV from the blasting device 100 (see FIG. 1) through the first sub-cable 410 included in the sub-cables 400 of the cables 300 and 400 (see FIG. 1).

The charging circuit 210 may receive a charge signal CS from the control circuit 220. The charging circuit 210 may performing a charging operation using the reference voltage PV while the charge signal CS is not being provided. The charging circuit 210 may not charge the detonator 200 with the reference voltage PV while the charge signal CS is provided.

The charging circuit 210 may supply a driving voltage DV to the control circuit 220 on the basis of the charged voltage. Here, the control circuit 220 may be operated on the basis of the driving voltage DV.

The control circuit 220 may receive the reference voltage PV from the blasting device 100 through the first sub-cable 410 and may receive the ground voltage GND from the blasting device 100 through the second sub-cable 420.

The control circuit 220 may receive a first signal from the blasting device 100 through the cables 300 and 400. The first signal may be a pulse signal based on the reference voltage PV applied to the cables 300 and 400 by the blasting device 100.

The control circuit 220 may transmit a second signal to the blasting device 100 through the cables 300 and 400 in response to the first signal. The second signal may be a pulse signal based on the reference signal.

In addition, the control circuit 220 may provide the charge signal CS to the charging circuit 210 while transmitting the second signal to the blasting device 100. While the charge signal CS is provided, the charging circuit 210 may stop the charging operation using the reference voltage PV.

In some embodiments, the first signal may be a blasting command including a delay time. Here, the control circuit 220 may count the delay time included in the first signal. When the counting of the delay time is completed, the control circuit 220 may generate a blasting signal BS and transmit the blasting signal BS to the ignition circuit 230. The control circuit 220 may generate a blasting voltage BV on the basis of at least one of the driving voltage DV and the reference voltage PV. The control circuit 220 may provide the blasting voltage BV to the ignition circuit 230.

The ignition circuit 230 may supply the blasting voltage BV to the fuse head 240 in response to the blasting signal BS. The fuse head 240 may ignite when the blasting voltage BV is supplied thereto.

Although not shown in FIG. 3, in some embodiments, the detonator 200 may further include a protection circuit to protect internal circuit components from the voltages supplied through the cables 300 and 400.

Figure 4:
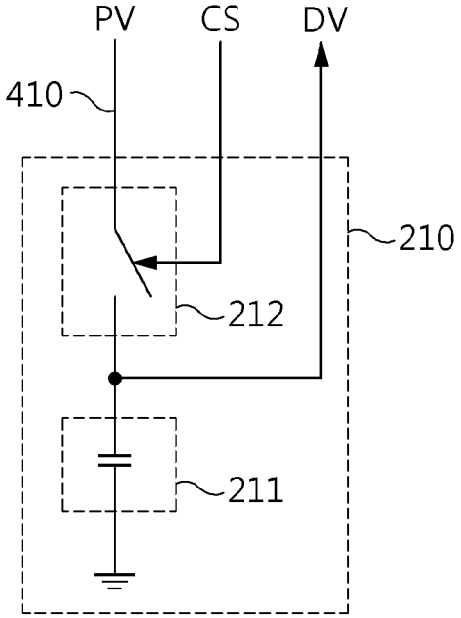
FIG. 4 is a diagram illustrating a charging circuit according to embodiments of the present invention.

FIG. 4 is a diagram illustrating the charging circuit 210 according to embodiments of the present invention.

Referring to FIG. 4, the charging circuit 210 may include a charger 211 and a charging switch 212.

The charger 211 may perform the charging operation by receiving the reference voltage PV supplied through a cable (i.e. the first sub-cable 410). The charger 211 may supply the driving voltage DV to the control circuit 220 (see FIG. 2) on the basis of the charged reference voltage PV. For example, the charger 211 may include a capacitor charging the reference voltage PV.

The charging switch 212 may be disposed between the cable (i.e. the first sub-cable 410) and the charger 211. The charging switch 212 may control the supply of the reference voltage PV to the charger 211, in response to the charge signal CS. For example, the charging switch 212 may include a switch that is turned off while the charge signal CS is provided. In some embodiments, the charging switch 212 may be implemented as a P-channel field effect transistor (FET).

Figure 5:
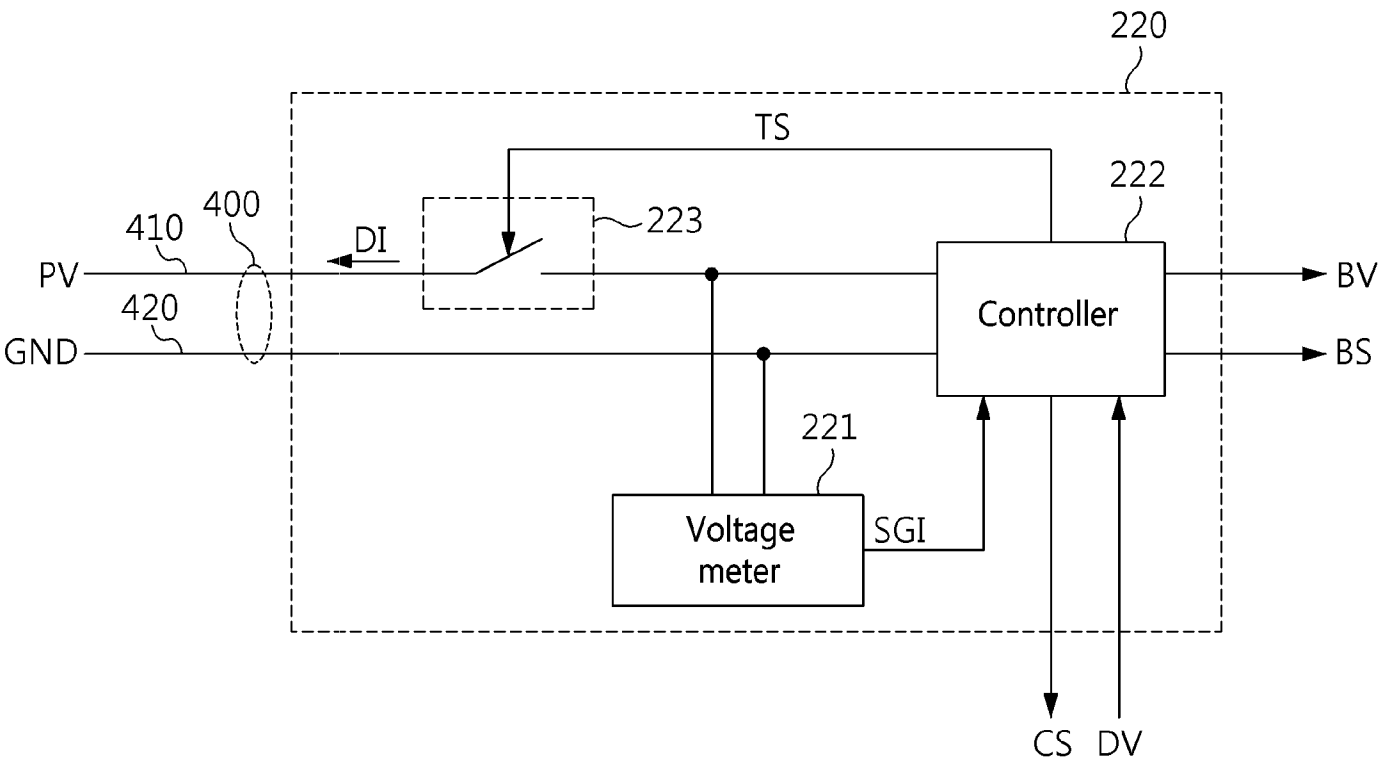
FIG. 5 is a diagram illustrating the control circuit according to embodiments of the present invention.

FIG. 5 is a diagram illustrating the control circuit 220 according to embodiments of the present invention.

Referring to FIG. 5, the control circuit 220 may include a voltage meter 221, a controller 222, and a control switch 223. The control circuit 220 may be connected to the sub-cables 400, which may include the first sub-cable 410 and the second sub-cable 420.

The voltage meter 221 may measure the voltage of the first sub-cable 410 and the second sub-cable 420. That is, the voltage meter 221 may measure the reference voltage PV supplied through the first sub-cable 410 and the ground voltage GND supplied to the second sub-cable 420. The voltage meter 221 may extract a first signal SG1 on the basis of the result of measurement of the voltages. The voltage meter 221 may transmit the first signal SG1 to the controller 222.

The controller 222 may receive the first signal SG1.

The controller 222 may generate a toggle signal TS to generate a second signal in response to the first signal SG1. For example, the controller 222 may control the operation of the control switch 223 by transmitting the toggle signal TS to the control switch 223. The flow of reference current DI may be adjusted depending on the operation of the control switch 223. The second signal may be a pulse signal based on the reference current DI, and the controller 222 may generate the second signal using the toggle signal TS. Here, the reference current DI may be the current flowing from the detonator 200 to the blasting device 100 through the cables 300 and 400.

The control switch 223 may be disposed on the cables 300 and 400. For example, the control switch 223 may be disposed between the sub-cables 400 and the controller 222.

The control switch 223 may control the flow of the reference current DI in response to the toggle signal TS. For example, the control switch 223 may include a switch that is turned off while the toggle signal TS is provided. In some embodiments, the control switch 223 may be implemented as a P-channel FET.

The controller 222 may transmit the charge signal CS to the charging circuit 210 (see FIG. 3) while transmitting the second signal. In addition, the controller 222 may receive the driving voltage DV from the charging circuit 210.

In some embodiments, the first signal may be a blasting command including a delay time. Here, the controller 222 may count the delay time included in the first signal. When the counting of the delay time is completed, the controller 222 may generate the blasting signal BS, and may transmit the blasting signal BS to the ignition circuit 230. The controller 222 may generate the blasting voltage BV on the basis of at least one of the driving voltage DV and the reference voltage PV. In addition, the controller 222 may supply the blasting voltage BV to the ignition circuit 230 (see FIG. 3).

Figure 6:
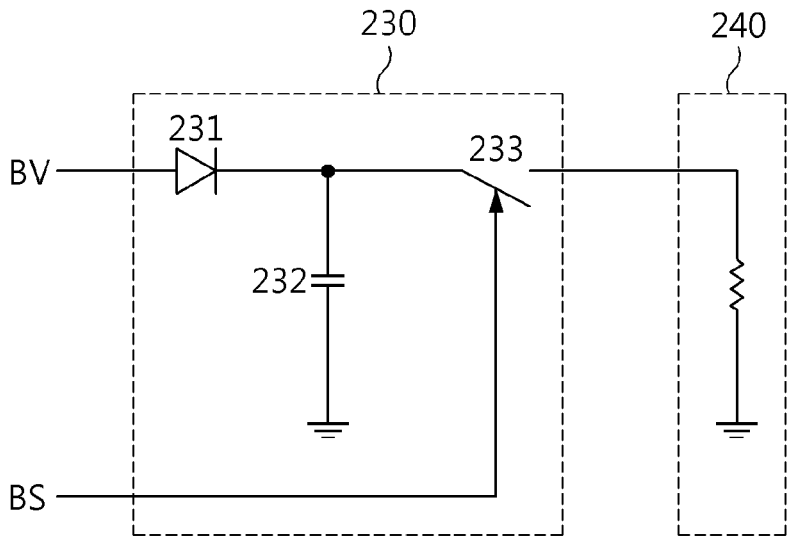
FIG. 6 is a diagram illustrating the detonating circuit according to embodiments of the present invention.

FIG. 6 is a diagram illustrating the ignition circuit 230 according to embodiments of the present invention. For the sake of brevity, only the ignition circuit 230 and the fuse head 240 are illustrated in FIG. 6.

Referring to FIG. 6, the ignition circuit 230 may include an ignition diode 231, an ignition capacitor 232, and an ignition switch 233.

The blasting voltage BV may be supplied to the ignition capacitor 232 through the ignition diode 231.

The ignition capacitor 232 may store the blasting voltage BV therein.

The ignition switch 233 may receive the blasting signal BS. The ignition switch 233 may be turned on while the blasting signal BS is provided. When the ignition switch 233 is turned on, the blasting voltage BV stored in the ignition capacitor 232 may be supplied to the fuse head 240. Since the blasting signal BS is provided to the ignition switch 233 after the delay time is counted, the fuse head 240 may receive the blasting voltage BV after the delay time is terminated.

As illustrated in FIG. 6, the fuse head 240 may have a unique resistance value. Accordingly, a voltage proportional to the unique resistance value may be applied to the fuse head 240. The fuse head 240 may ignite when the voltage is applied thereto.

Figure 7:
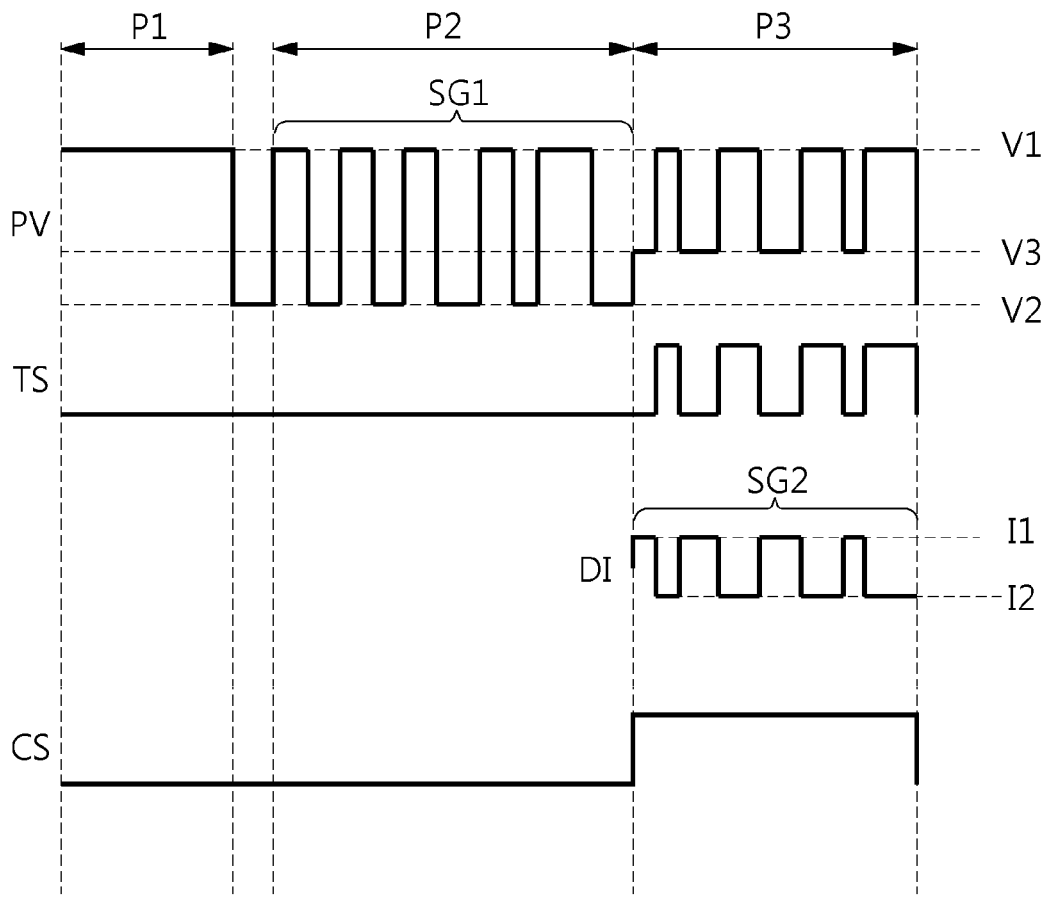
FIG. 7 is a waveform diagram illustrating an method of operating a detonator according to embodiments of the present invention.

FIG. 7 is a waveform diagram illustrating a method of operating a detonator according to embodiments of the present invention. In FIG. 7, the waveforms of the reference voltage PV, the toggle signal TS, the reference current DI, and the charge signal CS are illustrated according to a first period P1, a second period P2, and a third period P3.

Referring to FIGS. 1*a* to 7, the blasting device 100 may supply the reference voltage PV to the charging circuit 210 through the cables 300 and 400 during the first period P1. The charging circuit 210 of the detonator 200 may perform the charging by receiving the reference voltage PV. For example, during the first period P1, the reference voltage PV may have a first voltage value V1. In addition, during the first period P1, neither the toggle signal TS nor the charge signal CS may be supplied. In FIG. 7, in the supply of the toggle signal TS and the charge signal CS, the toggle signal TS and the charge signal CS are illustrated as having a high-level voltage. However, the present invention is not limited thereto, and each of the toggle signal TS and the charge signal CS may have a variety of voltage values.

During the second period P2, the control circuit 220 of the detonator 200 may receive the first signal SG1 from the blasting device 100. Here, the first signal SG1 may be a pulse signal based on the reference voltage PV. That is, the reference voltage PV may have the first voltage value V1 or a second voltage value V2 during the second period P2, and the control circuit 220 may extract the first signal SG1 by measuring variation in the reference voltage PV. In addition, during the second period P2, neither the toggle signal TS nor the charge signal CS may be supplied.

During the third period P3, the control circuit 220 of the detonator 200 may transmit the second signal SG2 to the blasting device 100 in response to the first signal SG1. Here, the second signal SG2 may be a pulse signal based on the reference current DI. That is, the reference current DI may have a first current value I1 or a second current value I2 during the third period P3, and the blasting device 100 may extract a second signal SG2 by measuring a variation in the reference current DI. Specifically, as described above, the controller 222 of the control circuit 220 may adjust the flow of the reference current DI by controlling the operation of the control switch 223. For example, the first current value I1 may be a value greater than 0A, and the second current value I2 may be 0A.

In some embodiments, when the toggle signal TS has a high-level voltage, the control switch 223 of the control circuit 220 may be turned off. Accordingly, as illustrated in FIG. 7, the reference current DI may have the second current value I2 when the toggle signal TS is at a high level.

During the third period P3, the controller 222 included in the control circuit 220 of the detonator 200 may transmit the second signal SG2, and may transmit the charge signal CS to the charging circuit 210. Here, the charge signal CS may have a high-level voltage. In some embodiments, when the charge signal CS has a high-level voltage, the charging switch 212 of the charging circuit 210 may be turned off. Consequently, the charging circuit 210 may stop the charging operation.

During the third period P3, as the charging operation of the charging circuit 210 is stopped, the blasting device 100 may maintain the reference voltage PV at the first voltage value V1, which has been supplied during the first period P1 and the second period P2. Since the movement of currents occurs in response to the supply of the second signal SG2, i.e. a current signal, the reference voltage PV may be changed to a third voltage value V3 while the reference current DI is supplied. Here, the third voltage value V3 may be smaller than the first voltage value V1 and greater than the second voltage value V2. The second voltage value V2 may be 0V in some embodiments, but the present invention is not limited thereto. The second voltage value V2 may be set to a variety of values, as long as the objective of the present invention is realized.

Differently from the illustration of FIG. 7, at least a portion of the first period P1 may overlap the second period P2. However, the present invention is not limited thereto, and in some embodiments, the first period P1 and the second period P2 may differ from each other, as illustrated in FIG. 7. In addition, as illustrated in FIG. 7, the second period P2 and the third period P3 may be continuous with each other.

Figure 8:
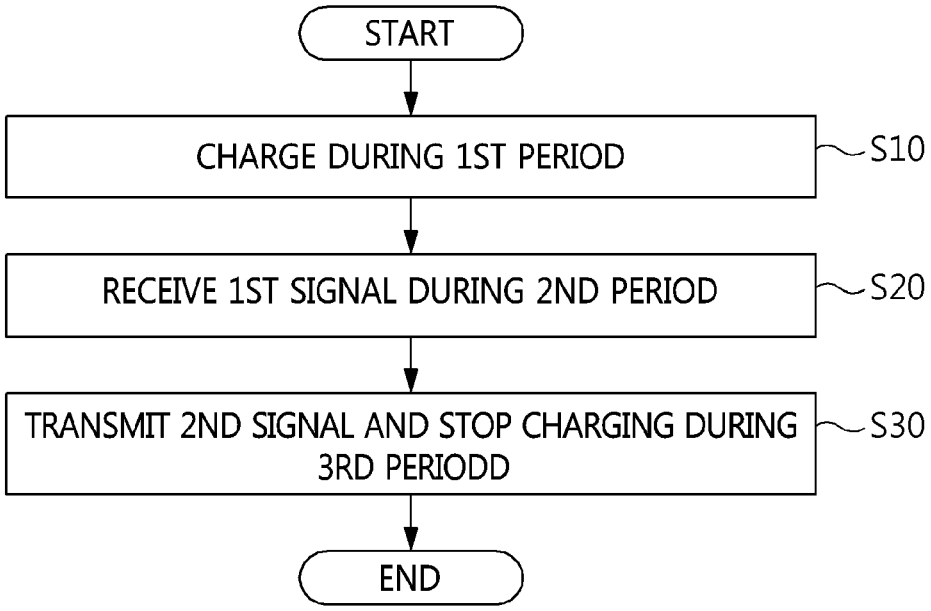
FIG. 8 is a flowchart illustrating the method of operating a detonator according to embodiments of the present invention.

FIG. 8 is a flowchart illustrating a method of operating a detonator according to embodiments of the present invention.

Referring to FIGS. 1*a* to 8, in step S10, the charging circuit 210 of the detonator 200 may perform the charging operation during the first period P1. That is, the charging circuit 210 may perform the charging operation by receiving the reference voltage PV from the blasting device 100 through the cables 300 and 400. In addition, the charging circuit 210 may supply the driving voltage DV to the control circuit 220 of the detonator 200. Here, the driving voltage DV may be a voltage corresponding to the charged reference voltage PV.

In step S20, the control circuit 220 may receive the first signal SG1 during the second period P2. That is, the control circuit 220 may receive the first signal SG1 including the delay time from the blasting device 100 through the cables 300 and 400. Here, the delay time may be an ignition start time set for the detonator, and the first signal SG1 may be a pulse signal based on the reference voltage PV.

In step S30, the control circuit 220 may transmit the second signal SG2 to the blasting device 100 and stop the charging operation, in response to the first signal SG1, during the third period P3. That is, the control circuit 220 may transmit the second signal SG2 to the blasting device 100 through the cables 300 and 400 during the third period P3. In addition, the control circuit 220 may transmit the charge signal CS to the charging circuit 210 to stop the charging operation of the charging circuit 210. Consequently, the charging circuit 210 may stop the charging operation in response to the charge signal CS.

As set forth above, the detonator, the method of operating the same, and the communication system for the same according to embodiments of the present invention can reduce an amount of charging current and improving a signal-to-noise ratio (SNR).

In addition, the detonator, the method of operating the same, and the communication system for the same according to embodiments of the present invention can reduce a variation in a reference current depending on changes in the number of detonators, thereby increasing the maximum number of detonators with which communication is possible.

Although the exemplary embodiments of the present invention have been described for illustrative purposes, those skilled in the art or those having ordinary knowledge in the art will appreciate that various modifications, additions and substitutions are possible without departing from the scope and spirit of the present invention as disclosed in the accompanying claims.

Therefore, the technical scope of the present invention is not limited to the exemplary embodiments described herein, but should be determined on the basis of the claims.

The invention claimed is:

1. A detonator comprising:

a charging circuit performing a charging operation by receiving a voltage through a cable from a blasting device during a first period; and a control circuit receiving a first signal transmitted using the voltage applied to the cable by the blasting device during a second period and transmitting a second signal to the blasting device using a current flowing to the cable during a third period, wherein the charging circuit stops the charging operation while the control circuit transmits the second signal to the blasting device, wherein the charging circuit includes:

a charger performing the charging operation by receiving the voltage supplied thereto; and a charging switch disposed between the charger and the cable to control a supply of the voltage to the charger in response to a charge signal, wherein the control circuit transmits the charge signal to the charging switch while the control circuit transmits the second signal to the blasting device during the third period, and wherein the charging switch includes a switch that is turned off while the charge signal is provided during the third period, thereby cutting off the supply of the voltage to the charger.

2. The detonator according to claim 1, wherein the control circuit includes:

a voltage meter extracting the first signal by measuring the voltage;

a controller receiving the first signal and generating a toggle signal; and a control switch disposed on the cable to control the current flowing to the cable in response to the toggle signal.

3. The detonator according to claim 2, wherein the control switch includes a switch that is turned off while the toggle signal is provided.

4. The detonator according to claim 1, wherein the control circuit counts a delay time included in the first signal and generates a blasting signal and a blasting voltage.

5. The detonator according to claim 4, further comprising an ignition circuit to supply the blasting voltage to a fuse head in response to the blasting signal.

6. A method of operating a detonator including a control circuit counting a delay time included in a first signal and generating a blasting signal and a blasting voltage and a charging circuit providing a driving voltage to the control circuit, the method comprising:

performing, by the charging circuit, a charging operation by receiving a voltage from a blasting device through a cable during a first period;

receiving, by the control circuit, a first signal transmitted using a voltage applied to the cable by the blasting device during a second period; and transmitting, by the control circuit, a second signal to the blasting device using a current flowing to the cable and stopping, by the charging circuit, the charging operation during a third period, wherein the charging circuit includes:

a charger performing the charging operation by receiving the voltage supplied thereto; and a charging switch disposed between the charger and the cable to control a supply of the voltage to the charger in response to a charge signal, wherein the control circuit transmits the charge signal to the charging switch while the control circuit transmits the second signal to the blasting device during the third period, and wherein the charging switch includes a switch that is turned off while the charge signal is provided during the third period, thereby cutting off the supply of the voltage to the charger.

7. The method according to claim 6, wherein at least a portion of the first period overlaps the second period.

8. The method according to claim 6, wherein the second period and the third period are continuous with each other.

9. A communication system comprising a transmitter and a receiver connected through a cable, wherein the transmitter transmits a first signal to the receiver using a voltage applied to the cable during a first communication period, and the receiver includes:

a control circuit receiving the first signal and transmitting a second signal to the transmitter using a current flowing to the cable during a second communication period; and a charging circuit performing a charging operation by receiving the voltage through the cable during a charging period, wherein the charging circuit stops the charging operation while the control circuit transmits the second signal to the blasting device, wherein the charging circuit includes:

a charger performing the charging operation by receiving the voltage supplied thereto; and a charging switch disposed between the charger and the cable to control a supply of the voltage to the charger in response to a charge signal, wherein the control circuit transmits the charge signal to the charging switch while the control circuit transmits the second signal to the blasting device during the second communication period, and wherein the charging switch includes a switch that is turned off while the charge signal is provided during the second communication period, thereby cutting off the supply of the voltage to the charger.

10. The communication system according to claim 9, wherein the control circuit includes:

a voltage meter extracting the first signal by measuring the voltage;

a controller receiving the first signal and generating a toggle signal; and a control switch disposed on the cable to control the current flowing to the cable in response to the toggle signal.

11. The communication system according to claim 10, wherein the control switch includes a switch that is turned off while the toggle signal is provided.

* * * * *